United States Patent [19]

Lehr et al.

[11] 4,287,053

[45] Sep. 1, 1981

[54] BENEFICIATION OF HIGH CARBONATE PHOSPHATE ORES

[75] Inventors: James R. Lehr; Shuang-shii Hsieh, both of Florence, Ala.

[73] Assignee: Tennessee Valley Authority, Muscle Shoals, Ala.

[21] Appl. No.: 218,896

[22] Filed: Dec. 22, 1980

Related U.S. Application Data

[63] Continuation of Ser. No. 146,579, May 5, 1980.

[51] Int. Cl.[3] ..... B03D 1/06

[52] U.S. Cl. ..... 209/167

[58] Field of Search ..... 209/166, 167

[56] References Cited

U.S. PATENT DOCUMENTS

| | | | |
|---|---|---|---|
| 1,813,343 | 7/1931 | Cunningham | 209/166 |
| 2,162,494 | 6/1939 | Trotter | 209/166 |
| 2,689,043 | 9/1954 | Fischer | 209/166 |
| 3,113,838 | 12/1963 | Perre | 209/166 X |
| 3,462,016 | 8/1969 | Bushell | 209/166 |
| 3,480,143 | 11/1969 | Mitzmager | 209/166 |
| 3,929,629 | 12/1975 | Griffith | 209/167 |
| 4,008,151 | 2/1977 | Smani | 209/167 X |
| 4,229,287 | 10/1980 | Lepetic | 209/167 |

OTHER PUBLICATIONS

Chem. Abst. 81, 1974, 109040m.

*Primary Examiner*—Robert Halper
*Attorney, Agent, or Firm*—Robert A. Petrusek

[57] ABSTRACT

A phosphate ore flotation process subjecting a phosphate ore containing carbonate mineral impurities to froth flotation in the presence of phosphate depressants, said depressants are alkyl phosphonic acids, and a carbonate collector, said collector is fatty acids, removing the separated carbonate minerals from the overflow, and recovering the phosphate value in the underflow. The process of the present invention can be performed either prior to or after the separation of siliceous matter from phosphate minerals by methods known in the art.

6 Claims, No Drawings

BENEFICIATION OF HIGH CARBONATE PHOSPHATE ORES

The invention herein described may be manufactured and used by or for the Government for governmental purposes without the payment to us of any royalty therefor.

This application is a continuation of application Ser. No. 146,579, filed May 5, 1980, for BENEFICIATION OF HIGH CARBONATE PHOSPHATE ORES.

The present invention relates to a phosphate ore beneficiation process, and more particularly the present invention relates to the use of alkyl phosphonic acids as depressants for beneficiating phosphate ores containing alkaline earth metal carbonate mineral impurities.

Current beneficiation practices for phosphate ores commonly utilize flotation as the principal step for separating phosphates from gangue minerals. The "Crago" or "double float" froth flotation process is commercially used for beneficiating such phosphate ores in which silica and silicate minerals are the predominant constituents of gangues. That process consists of conditioning the material with fatty acids and fuel oil, flotation of phosphate minerals, deoiling with sulfuric acid to remove the reagents, and refloating with amine reagents to remove the siliceous gangue which either floated or was trapped in the rougher float.

However, many phosphate ores of potential commercial value contain carbonate gangue mineral matter in addition to siliceous minerals. These carbonate mineral impurities include dolomite, calcite, dolomitic limestone, sea shell and other less common carbonate-type minerals. Such mineral impurities not only dilute the $P_2O_5$ content of the phosphate ore concentrate, but also may interfere in subsequent chemical processing. For example, carbonate minerals present in phosphate ore concentrates used to produce phosphoric acid, superphosphate, or triple superphosphate consume sulfuric acid in the acidulation steps without providing additional fertilizer values. They aggravate foam formation in the reactor vessel. The presence of dolomite or dolomitic limestone in the phosphate ore concentrate is particularly important because relatively small amounts of magnesium (i.e., $>1$ percent MgO) may cause technical problems in current wet-process acid chemical plants due to increased viscosity of acid, increased defoamer usage, scale and sludge formation, and possibly difficulty in maintaining a standard diammonium phosphate (DAP) fertilizer grade.

The "double float" process has generally been ineffective for beneficiating such high carbonate phosphate ores. Collectors such as fatty acids used for phosphate minerals generally float carbonate minerals as well, and it is only by the employment of suitable selective depressants of either phosphate or carbonate gangue that adequate selectivity can be obtained.

The present invention provides an effective froth flotation process for beneficiating phosphate ore containing carbonate mineral impurities. The froth flotation is performed in the presence of a phosphate mineral depressant, said depressant being an alkyl phosphoric acid, and in the presence of a carbonate mineral collector, said collector being a fatty acid type reagent, removing carbonate mineral impurities from the overflow, and recovering phosphate values in the underflow.

Phosphate ores which are beneficiated by the method of this invention may naturally occur in discrete particles, or if not, may be comminuted and classified to desired size ranges by methods known in the art. A particle size smaller than about 28 mesh is preferably used for the flotation process. With larger particle size, an appreciable quantity of the gangue minerals may remain locked with the apatite. Furthermore, the larger ore particles are sometimes difficult to float. Very small particles, e.g., smaller than about 400 mesh, are removed by a desliming process. Although the slime may contain phosphate values, their relatively large consumption of reagents makes their beneficiation economically unattractive in relation to recoverable values of $P_2O_5$.

In practicing the present method, the phosphate ores containing siliceous gangues preferably is first beneficiated by conventional techniques, such as "double float" froth flotation process, to concentrate the phosphate values. Subsequently, the phosphate concentrate containing carbonate mineral impurities is subjected to a final stage of flotation employing the method of the present invention to remove carbonate minerals and produce a salable product. Alternatively, the carbonate impurities present in the ores can also be removed first with the method of the present invention and then followed by removing silica from phosphate with conventional methods known in the art.

One preferred class of phosphoric acids used as a phosphate mineral depressant is hydroxylethylidene diphosphonic acid, also referred to as methylhydroxy diphosphonate, which consists of one hydroxyl group and one methyl group attached to the bridge carbon of the ($O_3P—C—PO_3$) group. During the experimental work leading to the present invention, it was found that the diphosphonic acid is preferentially and firmly adsorbed or bonded on the phosphate mineral surface in apparently analogous behavior to inorganic pyrophosphates, which have a similar molecular configuration ($O_3P—O—PO_3$). This preferential adsorption of diphosphonate and its chemical stability in aqueous flotation results subsequently in reducing the adsorption of fatty acid collector on phosphate minerals. Furthermore, the short hydrocarbon chain (methyl group) and hydroxyl group of diphosphonic acid also make phosphate mineral surfaces less hydrophobic and hence less floatable. Carbonate minerals, which are less subjected to adsorption of diphosphonic acid, therefore can be successfully separated from phosphate with addition of fatty acids as the collector.

The practice of the present invention is demonstrated in one embodiment thereof by the results in flotations using a highly dolomitic Florida phosphate ore. The flotation feed was a minus 28- plus 400-mesh fraction of the high carbonate Florida matrix. The feed was first conditioned with diphosphonic acid as phosphate depressant. Fatty acid and fuel oil were then added as collector and auxiliary collector for carbonate minerals, which were floated and removed in the froth with a very insignificant loss of phosphate minerals. The phosphate minerals with siliceous impurities were removed in the underflow for further treatment. The separation of phosphate from siliceous matter can be performed with "double float" or any other conventional process known in the art. Without using phosphonic acid as depressant, the carbonate and phosphate minerals cannot be separated effectively by employing fatty acid as a collector. The present invention is further illustrated by the following examples. Note: Example I is a negative example, i.e., it illustrates what happens without the use of a depressant.

In order that those skilled in the art may better understand how the present invention can be practiced, the following examples are given by way of illustration and not necessarily by way of limitation.

EXAMPLE I

A Florida phosphate ore containing dolomitic minerals was used in this example. The minus 28- plus 400-mesh fraction which was used as flotation feed contains about 6.3 percent $P_2O_5$, 1.2 percent MgO, and 72 percent $SiO_2$. A 500-gram flotation feed was introduced into the Denver (Model No. D-12) laboratory conditioning equipment, and the pulp density was adjusted to about 65 percent solids (by weight) by the addition of sufficient water. The slurry was then conditioned with 0.14 kg/ton of oleic acid and 0.28 kg/ton of fuel oil per ton of feed. The impeller speed for conditioning was 500 rpm (about 6.5 ft/sec. tip speed) and the conditioning time was 2.5 minutes. The pH of conditioning slurry was 7.5 at the end of the conditioning. After conditioning, the pulp was transferred to a Denver 500-gram flotation cell and diluted with sufficient tap water. The pulp was then floated to remove carbonate impurities, the float and sink were then filtered, oven dried, and analyzed. The flotation results are shown in table I, which indicates that the fatty acid collector floated phosphate (19.6 percent $P_2O_5$ in float) as well as dolomite (3.8 percent MgO in float). The results are shown in table I below.

TABLE I

| Product | Wt. % | % $P_2O_5$ | % MgO | % $SiO_2$ |
|---|---|---|---|---|
| Float | 23.2 | 19.6 | 3.8 | 19.2 |
| Sink | 76.8 | 2.1 | 0.44 | 90.6 |
| Head | 100.0 | 6.2 | 1.21 | 73.0 |

EXAMPLE II

The phosphate ore flotation was performed as outlined in Example I, supra, except that in addition, phosphonic acid was used as a phosphate mineral depressant. The flotation feed was first conditioned for one minute with 0.08 kg/ton of Monsanto's Dequest 2010 (hydroxylethylidene diphosphonic acid), then for an additional 2.5 minutes with 0.14 kg/ton of oleic acid and 0.28 kg/ton of fuel oil. Conditioning percent solid was 65 percent and conditioning pH was 6.6. The treated ore slurry was transferred, diluted, and floated to remove carbonate minerals. The flotation results, as shown in table II below, indicate effective removal of carbonate minerals with insignificant loss of $P_2O_5$ in float (float contains 17.0 percent MgO, but only 2.5 percent $P_2O_5$).

TABLE II

| Product | Wt. % | % $P_2O_5$ | % MgO | % $SiO_2$ |
|---|---|---|---|---|
| Float | 2.2 | 2.5 | 17.0 | 9.6 |
| Sink | 97.8 | 6.4 | 0.7 | 73.3 |
| Head | 100.0 | 6.3 | 1.05 | 72.0 |

EXAMPLE III

The phosphate ore flotation was performed as outlined in Example II, supra, except that the dosage of oleic acid was increased to 0.28 kg/ton and fuel oil to 0.56 kg/ton. The conditioning pH was 6.8. The flotation results are shown in table III below. These results are similar to Example II, supra.

TABLE III

| Product | Wt. % | % $P_2O_5$ | % MgO | % $SiO_2$ |
|---|---|---|---|---|
| Float | 3.6 | 2.0 | 16.3 | 6.1 |
| Sink | 96.4 | 6.5 | 0.7 | 73.3 |
| Head | 100.0 | 6.3 | 1.27 | 70.9 |

EXAMPLE IV

The phosphate ore flotation was performed as outlined in Example II, supra, except that the dosage of oleic acid was greatly increased to 0.69 kg/ton and fuel oil to 1.38 kg/ton. The conditioning pH was 6.6. The flotation results are shown in table IV, infra. The data indicate that some phosphate was floated because of the excess dosage of fatty acid collector.

TABLE IV

| Product | Wt. % | % $P_2O_5$ | % MgO | %$SiO_2$ |
|---|---|---|---|---|
| Float | 7.9 | 14.0 | 8.5 | 7.1 |
| Sink | 92.1 | 5.4 | 0.4 | 74.2 |
| Head | 100.0 | 6.1 | 1.03 | 71.8 |

The results of the data from the above four examples illustrate that the use of the collector alone without the benefit of the depressant, as in example I, supra, floats both the phosphate and the dolomite, whereas in examples II and III, supra, the combination of predetermined amounts of both collector and depressant floated substantial amounts of the dolomite and only insignificant amounts of the phosphate. However, when the amount of collector exceeds the predetermined amount of depressant, as in example IV supra, a substantial amount of the phosphate is floated with the dolomite.

After sifting and winnowing through the data supra, as well as other results of tests, we now present the operating and preferred parameters and variables for flotation separation of the present invention.

| | Operating Range | Preferred Range |
|---|---|---|
| Feed size | −16 mesh + 10 micron | −28 mesh + 400 mesh |
| Pulp density (solid) | 20–74% | 65–72% |
| Depressant (kg/ton) | 0.01–0.5 | 0.05–0.25 |
| Collector (kg/ton) | | |
| Fatty acid | 0.05–2.0 | 0.1–1.5 |
| Fuel oil | 0–4.0 | 0.1–3.0 |
| Conditioning time (minutes) | | |
| Depressant | 1–5 | 1–2 |
| Collector | 1–10 | 1.5–3 |
| Conditioning impeller speed (rpm) | 300–1000 | 400–600 |
| Conditioning pH | 5–10 | 6–7 |

In addition to the information tabulated above, we have used as the phosphate depressant alkyl phosphonic acid materials such as, for example, hydroxylethylidene diphosphonic acid. Other representative materials in this class are monoalkyl, and dialkyl phosphonic acids. The feed materials used in the examples in this process were Florida phosphate rock. These materials are representative of a class of sedimentary phosphate ores containing alkaline earth metal carbonate mineral impurities. These carbonate mineral impurities include dolomite, calcite, dolomitic limestone, sea shell, and other less common minerals.

The general scheme of flotation used in checking out the parameters of the instant process is similar to known flotation schemes used for many years generally under operating conditions of ambient atmospheric pressures and temperatures, as is illustrated, for example, by the report on phosphate beneficiation in the September 1976 edition of Engineering and Mining Journal, beginning at page 81, et seq., said description of such prior-art methods incorporated herein by reference thereto.

While we have shown and described particular embodiments of our invention, modifications and variations thereof will occur to those skilled in the art. We wish it to be understood, therefore, that the appended claims are intended to cover such modifications and variations which are within the true scope and spirit of our invention.

What we claim as new and desire to secure by Letters Patent of the United States is:

1. An ore flotation process which comprises the steps of (1) subjecting a phosphate ore containing carbonate mineral impurities to froth flotation in the presence of a phosphate depressant, said depressant being selected from the group consisting of alkyl phosphonic acids, and a carbonate collector, said collector being a fatty acid;

(2) removing the separated carbonate minerals from the overflow; and (3) recovering the phosphate values in the underflow.

2. The process of claim 1 wherein said alkyl phosphonic acids are monoalkyl phosphonic acids.

3. The process of claim 1 wherein said alkyl phosphonic acids are dialkyl phosphonic acids.

4. The process of claim 1 wherein said alkyl phosphonic acid is hydroxylethylidene diphosphonic acid.

5. The process of claim 1 in which said fatty acids are employed as acid or as soap derivatives.

6. The process of claim 1 in which said fatty acids are employed in conjunction with fuel oil.

* * * * *